United States Patent [19]

Carlson

[11] Patent Number: 4,603,333

[45] Date of Patent: Jul. 29, 1986

[54] BOAT LIGHT-RADIO ANTENNA

[76] Inventor: Bradley C. Carlson, 950 Westbrook Way, #1, Hopkins, Minn. 55343

[21] Appl. No.: 521,722

[22] Filed: Aug. 9, 1983

[51] Int. Cl.[4] ..... H01Q 1/06

[52] U.S. Cl. ..... 343/709; 343/721; 343/903

[58] Field of Search ..... 343/721, 709–715, 343/901, 883, 902, 903, 894

[56] References Cited

U.S. PATENT DOCUMENTS

| | | | |
|---|---|---|---|
| 2,224,032 | 12/1940 | Kline | 343/721 |
| 2,252,395 | 8/1941 | Cohen | 343/715 |
| 2,420,772 | 5/1947 | Dalton | 343/721 |
| 2,496,601 | 2/1950 | Schamblin | 343/721 |
| 2,538,885 | 1/1951 | Schumann | 343/714 |
| 2,949,608 | 8/1960 | Fischer | 343/903 |
| 3,254,344 | 5/1966 | Rohrs | 343/901 |
| 3,680,131 | 7/1972 | Hall et al. | 343/721 |
| 4,062,156 | 12/1977 | Roth | 343/903 |
| 4,323,902 | 4/1982 | Hussey et al. | 343/901 |

*Primary Examiner*—Eli Lieberman
*Assistant Examiner*—Michael C. Wimer
*Attorney, Agent, or Firm*—Hugh D. Jaeger

[57] ABSTRACT

A telescoping boat light-antenna for use on a vessel which is recessed below the level of the deck when not being utilized and is capable of being extended to a predetermined height above the deck through a telescoping motor assembly when being utilized as either a boat light or an antenna. The light-antenna includes a recessed cup below a base plate which supports the light lens below deck level when recessed therein in a non-utilized position and provides for extension of the telescoping tubing when the light-antenna is in a telescoped position. The twofold purpose of the light and antenna provides for military function in communications command and control of the vessel as well as safety at sea.

1 Claim, 2 Drawing Figures

BOAT LIGHT-RADIO ANTENNA

BACKGROUND OF THE INVENTION

1. Field of the Invention

The present invention pertains to a boat light-antenna, and more particularly pertains to a boat light-antenna for use on pleasure as well as commercial and military vessels, and provides a sleek and functional appearance for command of the vessel as well as safety at sea.

2. Description of the Prior Art

The prior art boat lights, such as stern lights and anchor lights, have usually been on a fixed pole or on a telescoping pole which extends above the deck and presents a safety hazard as well as mechanical hazard. These types of lights have been less than suitable and satisfactory in providing functional usage as a boat light, and always require manual telescoping of the light to a utilizable position. The particular prior art stern lights and anchor lights, while functional in nature, have usually been crude mechanical assemblies which have not been refined on vessels such as pleasure boats and the like.

The prior art has also been devoid of combined boat light-antennas for use on vessels and which would eliminate deck clutter and extraneous fittings topside.

The present invention overcomes the deficiencies of the prior art by providing a combined boat light-antenna which is telescoping in an extended position and is recessed below and flat to the surface of the deck in the non-utilized stowed position.

SUMMARY OF THE INVENTION

The general purpose of the present invention is to provide a combined boat light-antenna for use on pleasure, commercial, and military boats and vessels, and can also be used on sailing vessels as well. The boat light-antenna has the dual functions of either an anchor light or stern light and also a telescoping antenna which can be utilized and loaded appropriately either on the high frequencies or the very high frequencies.

According to one embodiment of the present invention there is provided a telescoping-recess boat light-antenna including a base plate, a recessed housing attached to the base plate and including a hole therein, screw holes for securing the base plate to the deck of a vessel, a threaded light socket, a light-refracting chimney secured to the threaded light socket and having such a height as to be parallel and substantially flat to the base plate, the light chimney including a plurality of phenol lenses, a plurality of telescoping tubes secured to the light socket holder and extending downwardly therefrom, an electrically driven motor including a spool and a telescoping plastic longitudinal member secured thereto, an insulator between the motor housing and the lower end of the lowermost telescoping tube with the plastic tube extending upwardly therein, power wires connected through the telescoping tube between a switched power source and the light socket, a double-pole double-throw switch connected between the motor and the power source for actuating the motor either in an UP position or DOWN position, and an antenna wire connected to the telescoping tubes for loading of the telescoping tubes as an antenna whereby the recessed boat light can operate at any predetermined height and the antenna can operate either in a recessed position or an extended position and at any adjustable position between, depending upon the frequency of operation and the loading of the transmitter, thereby providing a recessed boat light-antenna.

One significant aspect and feature of the present invention is a boat light which when it is not being utilized is flush with the deck of the vessel for aesthetic purposes as well as safety. The base plate and recessed cup are such that the light lens when retracted to the base plate becomes a flush surface with very little room in between and a rubber washer thereabout providing for water-tight fit.

Another significant aspect and feature of the present invention is a boat light-antenna which provides the antenna acting in combination with the boat light, thus eliminating hardware which is installed on the boat deck.

Having thus described one embodiment of the present invention, it is a principal object hereof to provide a boat light-antenna operating in combination with each other to provide a combined vessel light whether it be a stern light or anchor light or bow light, and an antenna whether the antenna be UHF or HF.

One object of the present invention is a boat light-antenna which lends itself for utilization on pleasure, commercial, and military vessels. Another object of the present invention is to provide a boat light-antenna which is sleek in design, presenting minimal surface drag with respect to air and water, and is intended for use on high-speed vessels such as those vessels used by the military in intelligence operation, commercial vessels carrying passengers, or the like, and pleasure vessels carrying whatever.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
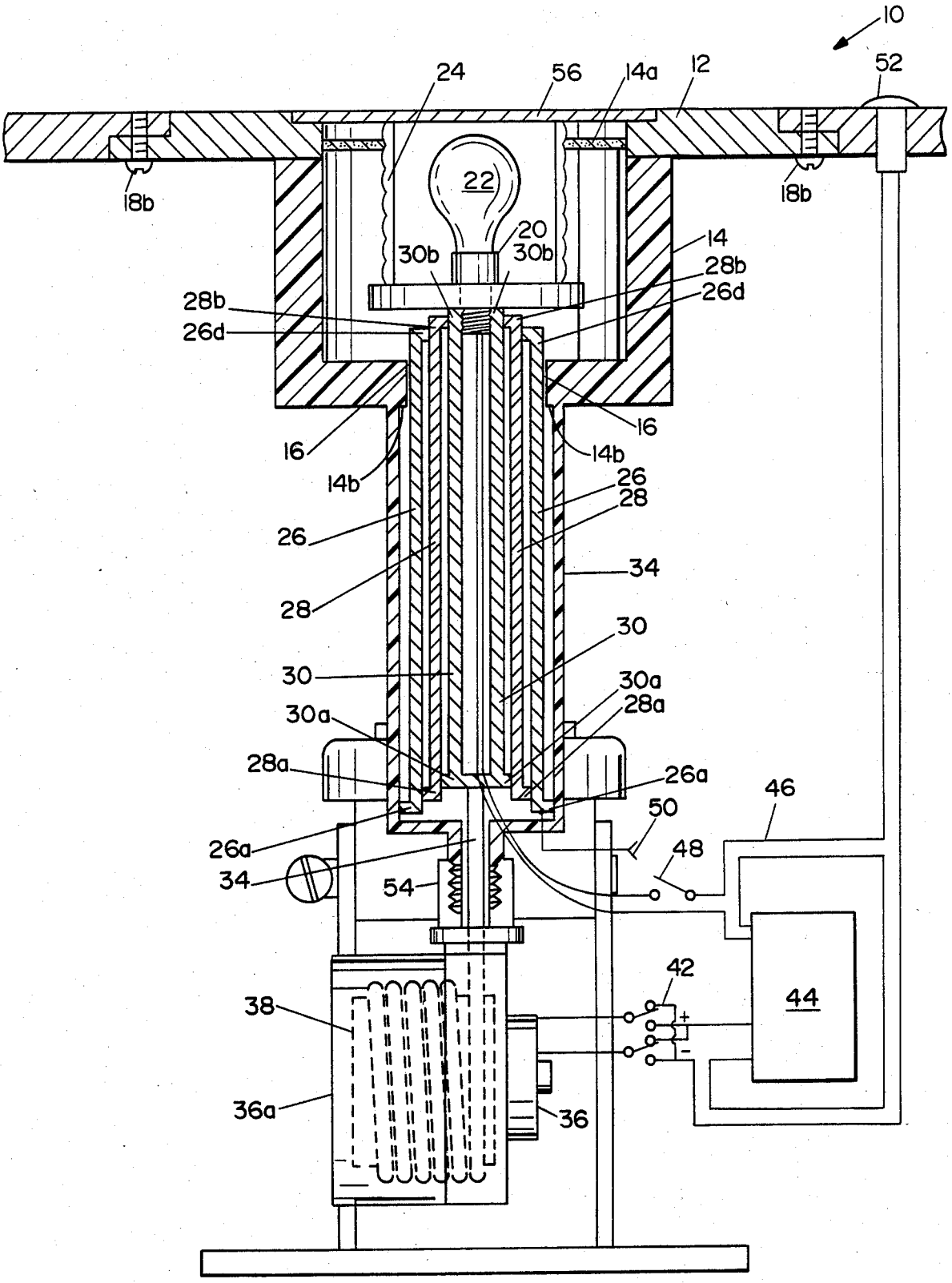
FIG. 1 illustrates a plan view of a telescoping-recessed boat light-antenna; and, FIG. 2 illustrates a plan view of the boat light-antenna in a utilized state.

FIG. 1 illustrates a plan view of a telescoping-recessed boat light-antenna 10, the present invention, including a base plate 12 of a marine-type material such as stainless steelplated metal or the like. The base plate can assume a very round configuration or a rectangular configuration, but is of such size as to support a recessed cup-like cylindrical housing 14 attached thereto which is of non-metallic material such as plastic, or any other like material which can be secured thereto either by gluing, screws or the like. The recessed housing 14 includes a bottom hole 16 therein for supporting of an outer telescoping tube 26. Screws 18*a* and 18*b* secure the base plate 12 to a deck of a vessel, as shown in cross section.

A threaded light socket 20 for supporting a light 22 and a light lens 24 such as a lens with a plurality of molded phenol lenses therein, is supported on one end of a smaller telescoping tube 30 with a center telescoping tube 28 therebetween, as later described in detail.

The light socket 20 can be mechanically secured to the inner telescoping tube 30, and can include mechanical structure such as threads or screw holes for securing the phenol light lens thereto. The light socket 20, the light 22, and the light lens 24 are of such a diameter and height to be accommodated by the recessed housing 14 so that the top of the base plate 12 is flush with the top of the light lens-chimney 24. The light lens-chimney 24 can be of plastic or glass. The recessed housing 14 can also include a rubber washer 14*a* for providing a weather-tight seal between the housing and the lens.

The telescoping tubes 26, 28 and 30 can be of aluminum, stainless steel, stainless steelplated or any other type of metal with diameters such that the tubes are telescoping with respect to each other and can be of any predetermined height. The number of tubes, three in this example, is by way of illustration and example only, and not to be construed as limiting of the present invention. The first telescoping tube 26 includes a lower flange 26*a* which slides within and mates with the flange 14*b* of the housing 14 when in an engaged position. The upper end of the tube includes a beveled end 26*b* which mates in an extended position with the lower flange 28*a* of the telescoping tube 28. This maintains the tubes within each other. Likewise, a beveled end 28*b* mates with flange 30*a* of the tube supporting the light at the end 30*b*. There can be any number of telescoping tubes and the number of poles of three indicated in this example has been for purposes of disclosure.

A tube of insulated material 34 extends from a motor housing 36*a* to about the flange 14*b* and encompassing thereabout providing for sliding and support of the telescoping tube 26 therein. The motor housing 36*a* includes a motor 36 including a spool of plastic rod material 38 for extending through the telescoping tubing providing for raising between a recessed position to an extended position. A double-pole double-throw switch 42 connects between a power source 44 and the motor 36 for raising or lowering the telescoping poles of the boat light-antenna 10. Power wires 46 connect from light 22, through switch 48, and to power source 44 for powering of the light. Antenna wire 50 connects to the telescoping tube 26 for powering the telescoping poles as an extendable antenna in either an HF or VHF mode. The wires 46 and 50 are flexible enought to slide within the space as provided during the telescoping of the tubes.

MODE OF OPERATION

Figure 2:
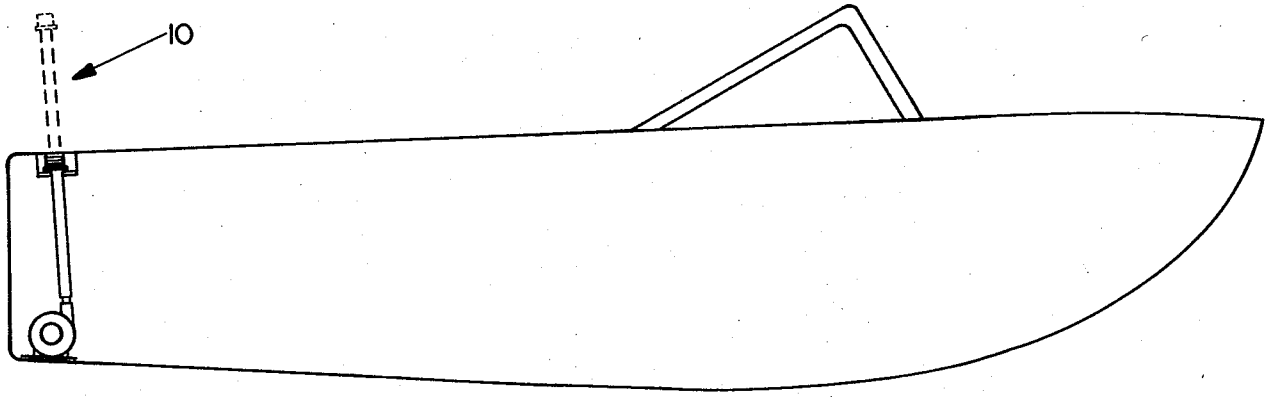

The telescoping-recess boat light-antenna 10 can be utilized as a boat light in an extended telescope configuration as illustrated in FIG. 2. The raising and lowering of the light through the telescoping poles is controlled by switch 42 where switch 48 controls the ON/OFF actuation of the light 24.

The telescope poles, depending upon length and loading characteristics, can function as an antenna particularly in the VHF mode of operation and a recessed position, but most likely in an extended telescoped position where the light poles might assume an odd number of wavelengths on the VHF band or full extended position for HF operation. The antenna can function in a recessed position, as illustrated in FIG. 1, or an extended position as illustrated in FIG. 2 when the boat light would be utilized at the same time.

A light sensor 52 can connect in the circuit for the power cable 46, and be located on a top portion of the deck for turning on the light when ambient light reaches a low level. The light sensor can also be wired to the motor for actuating the raising of the light.

The telescoping poles can be made from plastic tubing or the like which can be metal plated for providing the necessary metal surfaces for the antenna interaction of the telescoped poles. In the alternative, the poles can be a combination of metal and plastic such as the lower pole or poles metal while the upper pole or poles are metal.

Various modifications can be made to the present invention without departing from the apparent scope thereof. The number of telescoping poles is only suggested in this disclosure. Any number of suitable poles of metal or plastic can be utilized. Any suitable motor can be utilized with the spool for raising and lowering the telescoping poles of the boat light-radio antenna 10.

The spool is threaded at one end to accomdate connection to the light assembly. The end of the plastic rod is affixed to the light assembly by a suitable method such as adhesive or the like. A plastic insulator 54 is provided which can seperate the telescoping tubes from the motor-spool housing for purposes of the antenna structure of the combined boat light-radio antenna.

The light can also support a plug or flat planar member 56 as illustrated in dashed lines to cover over the recess and provides a flat appearance to the deck.

Having thus described the invention, what is claimed is:

1. Telescoping-recess boat light-antenna comprising:

a. base plate for mounting on a deck of a vessel and including a plurality of bolt holes about a circumference thereof, a recessed cylindrical cup-shaped housing attached and extending downwardly therefrom and affixed thereto and of a non-metallic material, a flange secured to a bottom of said cup housing and about a hole in the base of said housing;

b. a threaded light socket attached to an upper end of an inner diameter telescoping tubing, said light socket supporting a light and a phenol lens secured thereto, said light socket, light and phenol lens of such a height so as to be substantially flush with said base plate when fully retracted within said housing secured to said base plate;

c. plurality of telescoping tubes of decreasing diameters for telescoping within and respect to each other, said telescoping tubes having flanges at bottom ends and beveled upper ends;

d. a motor housing including a motor and a spool of non-conductive plastic rod material affixed to a bottom of a cylindrical insulative tubing, the top of said insulative tubing affixed to said flange of said recess housing;

e. a power source means including a double-pole double-throw switch affixed to said motor for driving said motor in a forward or a reverse position, and for raising and lowering of an end of said plastic rod material which is secured to said light socket, a second switch wired between said light and said power source for turning on and off said light; and, f. an antenna wire connected to the bottom of said telescoping tubing for feeding radio frequency current to the telescoping tubes whereby the telescoping tubes provide an extendable antenna in either a recessed or extended position and the telescoping tubes provide for raising and lowering of said light as desired to a predetermined height, thereby providing a combined telescoping-recessed boat light-antenna for a vessel for safety at sea.

* * * * *